US010019973B2

(12) United States Patent
Zider

(10) Patent No.: US 10,019,973 B2
(45) Date of Patent: Jul. 10, 2018

(54) AIRFLOW INDICATOR FOR WIND MUSICAL INSTRUMENTS

(71) Applicant: Robert Zider, San Antonio, TX (US)

(72) Inventor: Robert Zider, San Antonio, TX (US)

( * ) Notice: Subject to any disclaimer, the term of this patent is extended or adjusted under 35 U.S.C. 154(b) by 0 days.

(21) Appl. No.: 15/170,385

(22) Filed: Jun. 1, 2016

(65) Prior Publication Data

US 2017/0352337 A1 Dec. 7, 2017

(51) Int. Cl.
*G10D 9/00* (2006.01)

(52) U.S. Cl.
CPC ..... *G10D 9/00* (2013.01)

(58) Field of Classification Search
CPC ..... G10D 9/00
USPC ..... 84/453
See application file for complete search history.

(56) References Cited

U.S. PATENT DOCUMENTS 4,403,616 A * 9/1983 King ..... A63B 23/18 482/13
4,579,124 A 4/1986 Jentges
5,749,368 A 5/1998 Kase
6,399,867 B1 6/2002 Blocki et al.
6,570,077 B1 5/2003 Goss
2014/0090544 A1* 4/2014 Shinoda ..... G10H 1/0091 84/615
2015/0096431 A1* 4/2015 Perez ..... G10D 7/123 84/470 R

FOREIGN PATENT DOCUMENTS

AT 399788 B * 7/1995 ..... G10D 9/00
JP 4701974 B2 * 6/2011

* cited by examiner

*Primary Examiner* — Jianchun Qin
(74) *Attorney, Agent, or Firm* — Schwegman Lundberg & Woessner, P.A.

(57) ABSTRACT

An airflow indicator providing a visually observable measure of relative airflow through a wind musical instrument which facilitates evaluation proximate the end of the instrument. This allows airflow to traverse the majority of the length of the instrument and particularly to traverse the valve section, so that actions of a player in operating the valves which impair the airflow may be seen. Some examples may be configured to minimize differences in pitch between the wind musical instrument with the airflow indicator in place, relative to the wind musical instrument without the airflow indicator.

22 Claims, 8 Drawing Sheets

AIRFLOW INDICATOR FOR WIND MUSICAL INSTRUMENTS

BACKGROUND

The present disclosure relates generally to an airflow indicator for use with wind musical instruments, and more specifically relates to an airflow indicator which is configured to engage the instrument proximate the bell, and to provide an optical indicator of airflow through the instrument.

The methods and apparatus discussed herein are applicable to the wind family of musical instruments, those instruments in which wind by a player in the form of oscillating waves result in the sound to a listener (otherwise known as both woodwind and brass-wind instruments). Primarily of concern for the present description are the "brass-wind" instruments, in which the buzzing of a player's lips within a generally cup-shaped mouthpiece creates oscillations which pass through the instrument and result in the ultimate sound and pitch of the instrument, and the embodiments herein will be described in relation to a brass-wind musical instrument. The most common of such brass-wind instruments include trumpets, cornets, horns (elsewhere herein referred to as French horns, to avoid any confusion), trombones, baritones, euphoniums, and tubas. But as is apparent to persons skilled in the art, there are many additional types of brass-winds, including cornopeans, mellophones, bugles (of various sizes and playing ranges), etc. It should also be noted that the term brass-wind originated at a time when most wind instruments which operated in the described manner, with the buzzing of a player's lips within a mouthpiece, were manufactured of brass (though even long ago, so-called "brass" musical instruments were sometimes constructed of other metals, including iron, silver, and copper). In the modern usage of the term, such brass-winds refers to instruments played in the described manner, and has no correlation with the actual material of which the instruments are constructed, with brass-winds also including increasing numbers of instruments formed in whole or in part of various plastics and/or carbon fiber. Thus, the term "brass-wind" as used herein refers to any musical instrument for which the sound is originated by the buzzing of a player's lips within a generally cup-shaped mouthpiece.

For players of wind instruments, and particularly of brass-wind instruments, because of the importance of the airflow generated by a player to effective control and operation of the instrument to produce pleasing musical sounds, much attention has been devoted over the years to various aids to assist the player in understanding the airflow they are generating; and also to understanding times when they may be inadvertently impairing that airflow relative to what would be desirable for playing the instrument in a given situation. For example, players at all levels are encouraged to relax the body while playing. But when a brass-wind player attempts to play something he or she perceives as difficult, a player may force, and sense resistance from the instrument, suggesting to them that they are flowing air into the mouthpiece at a significant rate, when in fact, much of that resistance is the result of the player executing the Valsalva maneuver, thereby closing the epiglottis and restricting the air flow.

Various devices have been used to assist such wind players to visualize their airflow, ranging from blowing at one or more targets, such as a piece of paper or a string, to using spirometers and other devices used for therapies in the medical community. In some cases these may be used by the player directly (i.e. just blowing into the device), and in other cases may used with a mouthpiece, with the player buzzing on the mouthpiece into the device, such that the visualization can reflect what occurs when the player is actually vibrating the lips in the manner necessary to create sound from the instrument.

What is been recognized by the present inventor is that a significant deficiency of such methods is that they may not reflect what is actually occurring when a player is attempting to perform with the instrument. This discrepancy between what may be observed with the instrument versus what may be seen away from the instrument can have many causes. Sometimes a player's conditioned physical responses with the instrument are different than when, for example, the player works only with the mouthpiece. In other situations, the player may move the valves of the instrument too slowly, or out of sync with changes in the lips, resulting in unintended and unrecognized disruptions in the airflow through the instrument. Such interruptions can result in "breaks" or other distortions of the sound of the instrument. The various embodiments and methods described and illustrated herein address the above-noted deficiency.

DETAILED DESCRIPTION

The present description describes methods and apparatus for providing an optical indicator of airflow through a wind instrument which facilitate evaluation proximate the end of the instrument, thereby allowing the airflow to traverse the majority of the length of the instrument and particularly to traverse the valve section, so that actions of a player in operating the valves which impair the airflow may be seen, in addition to any restrictions of the airflow originating with player.

The following detailed description refers to the accompanying drawings that depict various details of examples selected to show how particular embodiments may be implemented. The discussion herein addresses various examples of the inventive subject matter at least partially in reference to these drawings and describes the depicted embodiments in sufficient detail to enable those skilled in the art to practice the invention. Many other embodiments may be utilized for practicing the inventive subject matter than the illustrative examples discussed herein, and many structural and operational changes in addition to the alternatives specifically discussed herein may be made without departing from the scope of the inventive subject matter.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

Figure 1:
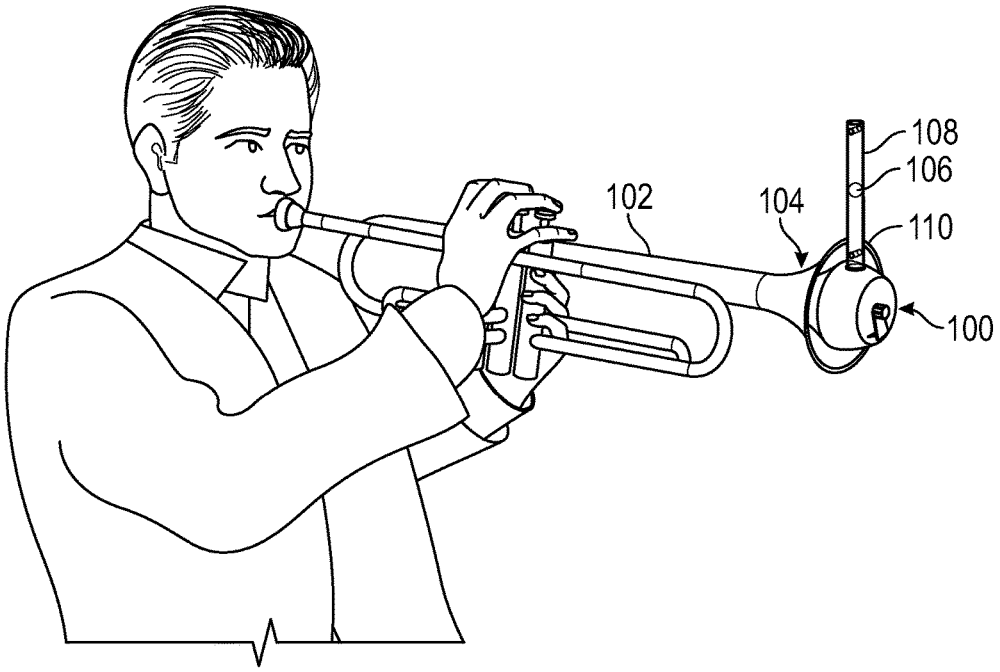
FIG. 1 depicts an example of a player playing a trumpet with an airflow indicator in accordance with the present description.

Referring now to FIG. 1, that figure depicts an example airflow visualizer or indicator 100 in place within a trumpet 102, and particularly within the bell portion of the trumpet, indicated generally at 104. Specifics features of the airflow indicator 100 will be discussed in more detail later herein. However, this example embodiment of airflow indicator 100 reflects airflow through the instrument by use of a movable indicator 106, here in the form of a ball, retained within a display tube 108, observable by the player. In FIG. 1, it can be seen that as the player is playing, the ball is elevated within tube 108 relative to where the ball would be found if the player were not playing (i.e. adjacent lower support pin 110).

Figure 2:
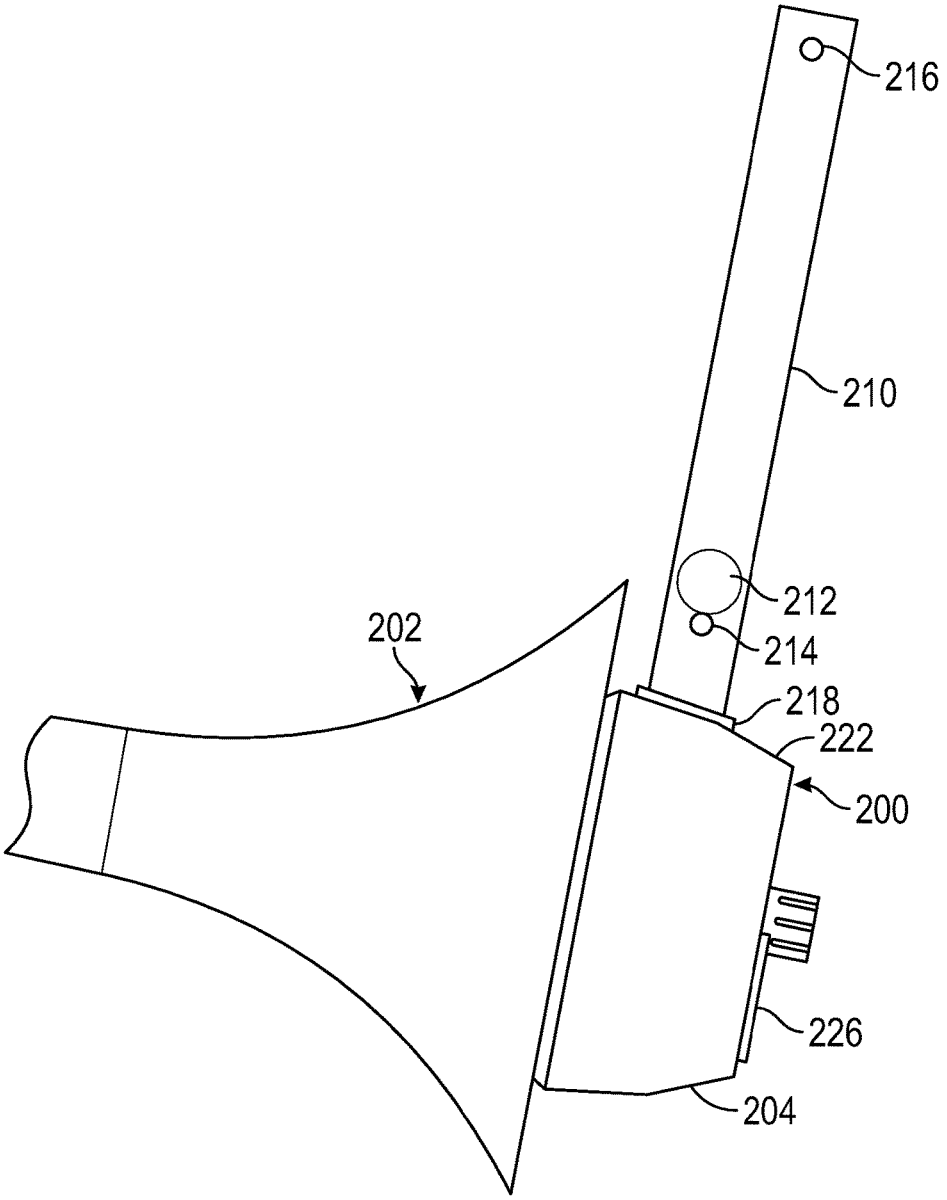
FIG. 2 depicts a side view of a brass-wind instrument bell, such as the trumpet of FIG. 1 with the airflow indicator.
Figure 3A:
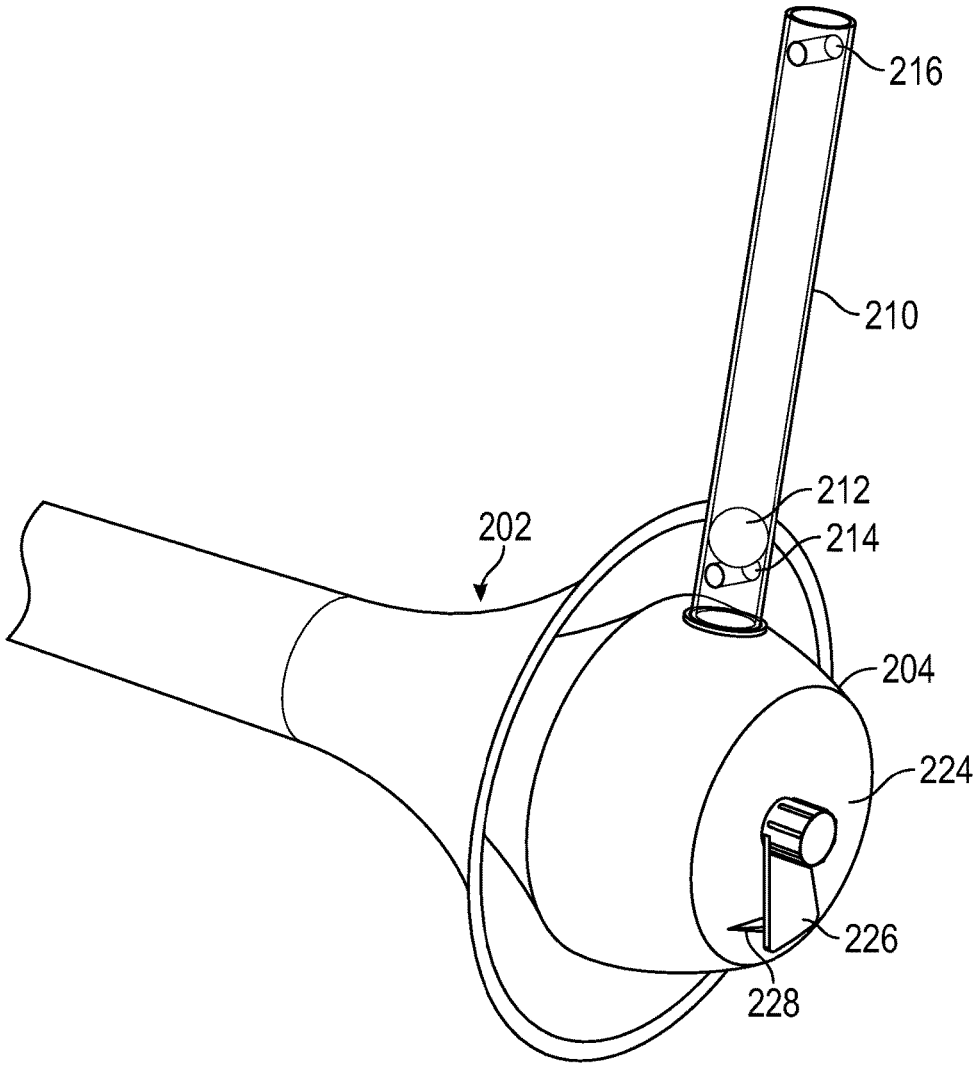
FIG. 3A depicts a side oblique view of the airflow indicator of FIG. 2.
Figure 4:
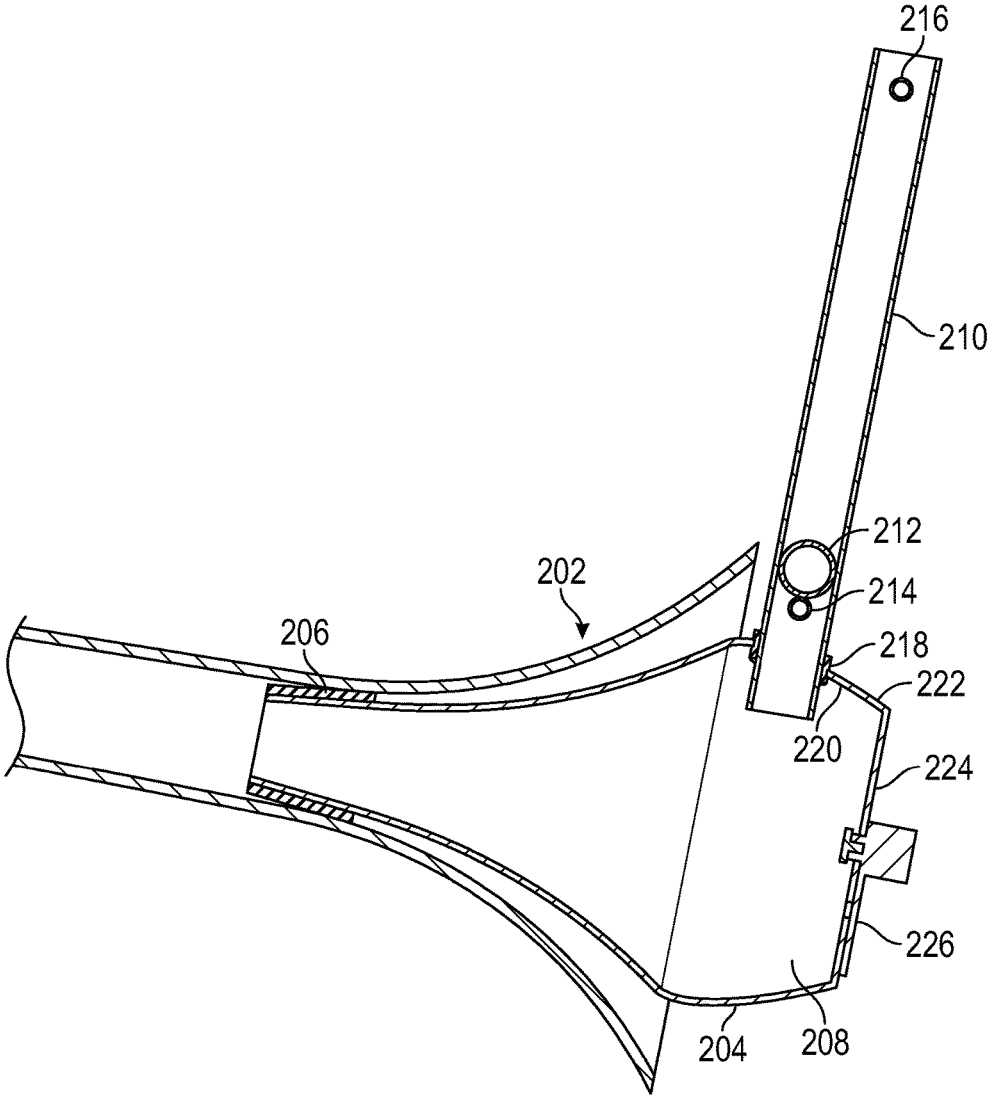
FIG. 4 depicts a cross-sectional representation of the airflow indicator of FIG. 2 within the instrument bell portion.

Referring now to FIGS. 2, 3A, and 4, the figures depict an example airflow indicator 200 (similar to that depicted in FIG. 1), in place within a bell section 202 of a brass-wind instrument, here again generally in the form of a trumpet. When the present description references the "bell section" of the musical instrument, the reference refers to that portion of the instrument forming the last portion of the air path through the instrument where, at least in most modern instruments, the taper of the instrument expands at a faster rate. For point of reference, the bell section of an instrument would also be generally that portion that would receive a conventional mute for that instrument (allowing for differences between different configurations of mutes).

Airflow indicator 200 includes a body member 204 serving as a closure member relative to the instrument. In many embodiments, body member 204 will have at least a lower portion (relative to the bell of the instrument) having an external configuration allowing it to engage and be retained within the bell portion 202 in essentially the same manner that an instrument mute would be retained within the bell portion 202. The example airflow indicator 200 therefore includes a sealing element 206 (viewable in FIG. 4) which engages an internal surface of the bell portion 202, providing a friction fit therein. The sealing element 206 will in many embodiments present an essentially continuous surface around a general end portion of the body member, as shown. As a result, the sealing element prevents airflow past the sealing element 206, and therefore directs airflow from musical wind instrument into body member 204.

In other embodiments, the sealing element 206 may not be continuous, but may be segmented so as to provide some airflow around the exterior of body member 204. In that alternative configuration, sealing element 206 could include one or more pieces of sealing material spaced from one another to define one or more gaps through which air may flow.

As can best be seen in FIG. 4, body member 204 defines a partially closed internal chamber 208. In the depicted example, a display assembly responsive to air pressure within chamber 208 is provided by a display tube 210 housing a movable indicator, here in the form of a ball 212. In the depicted example, ball 212 is retained within tube 210 by a lower retention pin 214 and an upper retention pin 216 extending through the tube and blocking exit of the ball in either direction. Upper and lower retention pins, 216 and 214, respectively, can be, for example metal pins, engaging making apertures in tuba 210; and may be retained in place by any suitable mechanism, such as mere friction fit within the apertures or, alternatively, being adhesively retained in place.

In many embodiments, it will be preferable for tube 210 to be both generally rigid and generally linear. Additionally, tube 210 should have at least some transparent portion, though in many embodiments the entire tube will be transparent. Tube 210 extends into chamber 208 and is therefore in fluid communication with chamber 208. In the depicted example, showing one beneficial construction, tube 210 is removably coupled to body member 204 by being frictionally engageable with an elastomeric grommet 218 engaging an aperture 220 in a surface 222 of body member 204. This construction allows the tube 210 (and the retained ball 212) to be removed to make the device more compact, and thus more easily transportable without risk of damage. Another particular advantage of this construction for airflow indicator is that it is a unitary structure supported entirely by the instrument, and therefore is movable with the instrument. This allows essentially unrestricted freedom of movement of the player.

Referring now particularly to FIG. 3A, that figure depicts airflow indicator 200 from a front oblique view such that the end surface 224 can be seen. As noted above, internal chamber 204 is partially closed. As is apparent from the preceding discussion, one path for air out of internal chamber 208 is through tube 210 around ball 212. In many embodiments, it will be preferable to provide one or more additional paths for air to exit internal chamber 208. A desirable feature for some embodiments will be for airflow indicator 200 to include a valve assembly in the form of a movable member, movable to relatively open or close one or more apertures to control the permitted airflow from internal chamber 208. As can be seen in FIG. 3A, airflow indicator 200 includes a single tapering aperture 228 which may be relatively opened or closed by rotation of cover 226 secured to surface 224.

Figure 3B:
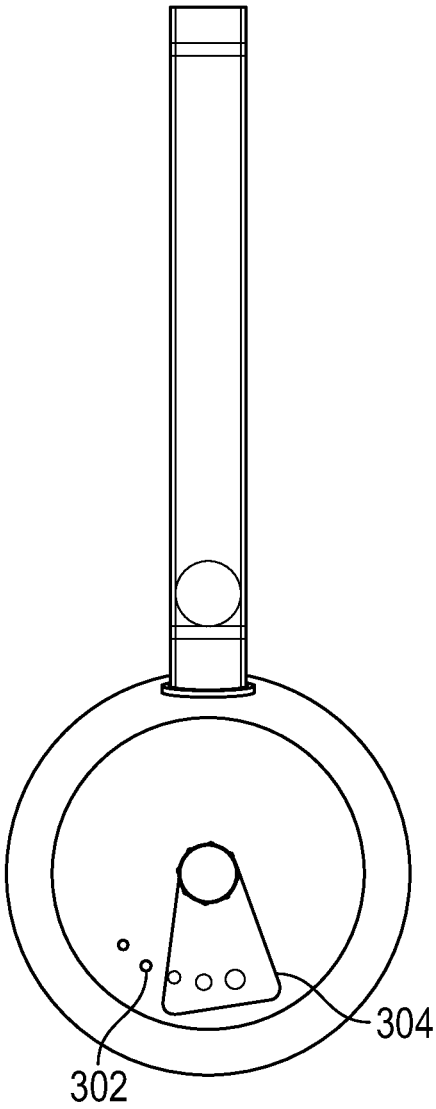
FIG. 3B depicts an end view of a variation for the airflow indicator of FIG. 3A.

Referring now particularly to FIG. 3B, therein is depicted an alternative configuration for an airflow indicator 300 which differs from airflow indicator 200 of FIGS. 2, 3A, and 4 only in having multiple apertures 302, in this example arranged along a radius, and increasing in size; and in having a wider dimension of cover 304 (relative to cover 226) in view of the multiple apertures 302. In other configurations, the apertures 302 might be all of the same size, or might be arranged differently.

When in use, the valve assembly can be used to control the dimension of the path(s) for airflow out of internal chamber 208 to account for differences in airflow such as can occur between players, or can occur for a single player in a different range of the instrument. Referring again also to FIG. 3A, for virtually all applications, merely adjusting the dimension of the air path out of internal chamber 208 by gradual adjustment of the position of cover 226 will be adequate. However, if desired, the dimensions of the aperture(s) and/or the position of the cover may be (generally speaking) calibrated with one another such that selected positions of the cover will result in a specific increment or decrement in the airflow path. As one such example, a plurality of similarly-sized apertures might be provided, and the engagement between the cover and the supporting surface might provide for a plurality of detents to provide a plurality of stopping points to which the cover might be rotated to achieve a selected incremental change in the air path (such as opening or closing an additional aperture) without requiring visual observation by a user.

As will be apparent to persons having the benefit of this disclosure, the observable indicia of airflow through the instrument are impacted by both the airflow around the ball 212 (or other movable indicator) within tube 210, and any airflow through any additional apertures (228) that are provided. One additional factor is the density of the ball or other moveable indicator.

Addressing first the airflow around the ball 212 within tube 210, the dimension of the airflow path around the ball is defined by the difference between the outer circumference of the ball and the inner circumference of the tube. Because the dimension of that area increases significantly with larger diameters, selection of the inner diameter of the tube and the outer diameter of the ball will impact performance of the visualizer. For many embodiments, a tube having an inner diameter of 0.525 inch, and a ball having a diameter of 0.5 inch has been found satisfactory. In various embodiments, the difference between the outer diameter of the ball (or outer dimension, if a non-spherical indicator is used) and the inner diameter of the tube (or inner cross-sectional dimension if a non-circular cross-sectioned tube is used) may be different than as stated above, though a difference between the dimensions of less than 0.035 inch will be advantageous. The length of the tube is much less of a factor, but a tube providing a range of travel for the ball of approximately 4 to 7 inches has been found satisfactory for use with visualizers for all brass-wind instruments. Instruments demanding a greater flow rate or air may be able to use airflow visualizers with a larger dimensioned tube and indicator, but such is not required.

Regarding the density of the ball or other movable indicator, for a system having the dimensions as described above, a ball having a density less than that of water, such that the ball will float on the surface of water, has been found satisfactory.

Although the various embodiments of airflow indicators described herein are addressed as to their primary visual indicator function, there is also useful auditory feedback to the player. Initiation of a tone (the "attack" of a note) by a player with sufficient pressure common in many playing situations will result in a quick rise of the ball within the tube, and a sharp "click" when the ball is stopped by the upper retention pin. This "click" can provide useful feedback to an individual player as to whether the airflow is initiated sufficient quickly. Additionally, if a group of players, such as a small ensemble, for example, were to each use an airflow indicator for their respective instruments, any offsets in the audible clicks from the multiple players at a common musical entrance will help highlight to all the players any misalignment of the attacks with one another, enabling addressing the issue.

One particular benefit that may be achieved through some example embodiments of the present devices and techniques is to allow visualization of the airflow through the instrument while playing, and to do so with a mechanism that does not result in a substantial change in the pitch of the produced sound relative to what would be produced by the "open" instrument (i.e. the instrument with no airflow indicator attached). In that regard, brass-wind mutes are well known that are designed to minimize the change in pitch between the open instrument, and the muted instrument, as significant changes in pitch resulting from insertion of the mute require adjustment of tuning of the instrument which can be problematic in some playing conditions. For purposes of the present description, change in pitch of the instrument would be "substantial" if it were in excess of 50 cents (i.e., one half of a semitone). Preferably, the change in pitch would be less than 25 cents, and a change in pitch of less than 10 cents would be considered minimal for purposes of the present description.

While a discussion of the physics and design methodology for brass-wind mutes is outside the scope of the present disclosure, existing mutes that provide "insubstantial" impact, or preferably "minimal" impact, on the pitch of the instrument, are well known for most brass-wind instruments. Many mutes that provide minimal impact on the pitch of the intended instrument-type are well known to persons skilled in the art. Accordingly, the physical configurations of such mutes may be adopted for the specific configuration of body member 204 (or for other instruments, for the body members of the airflow indicators for such other instruments). Examples of airflow indicators for other instruments are discussed herein in reference to FIGS. 5-7.

Another consideration for the body members of airflow indicators is that they significantly restrict, or prevent entirely, air flow around the body of the airflow indicator when installed in the bell portion of the instrument. "Practice mutes" are manufactured for virtually all common brass-wind instruments, and are used to severely reduce sound from an instrument, so as to allow practice in noise-sensitive locations, where the sound of the "open" instrument would be problematic. Many, if not most, practice mutes are configured to provide an insubstantial (and often minimal) change in the pitch of the instrument; and to provide an essentially complete seal around the body of the mute within the bell portion of the instrument. Thus the external configuration of such practice mutes can be advantageous for the outer configuration of the body portion of the airflow indicators as described herein. For trumpets and cornets, the external configuration of a Harmon (or Harmon-type) mute is another useful outer configuration of a mute suitable for the configuration of the body portion of the airflow indicators for those instruments.

As another alternative, an existing mute having desirable pitch consistency may be adapted and used as the body member as described herein. For example, in the instance of a trumpet, a trumpet practice mute or Harmon-type mute may be used as the body member. In other examples for trumpet, a straight mute body might be used with replacement of the widely spaced "corks" or (other instrument engaging members) with a continuous or almost continuous sealing member(s). Then, the forming of an aperture in the mute, such as in the side of the mute, near the wide end, would allow the insertion of an appropriate sized grommet to house an appropriate tube 210 with a retained ball 212, as discussed earlier herein.

Figure 5:
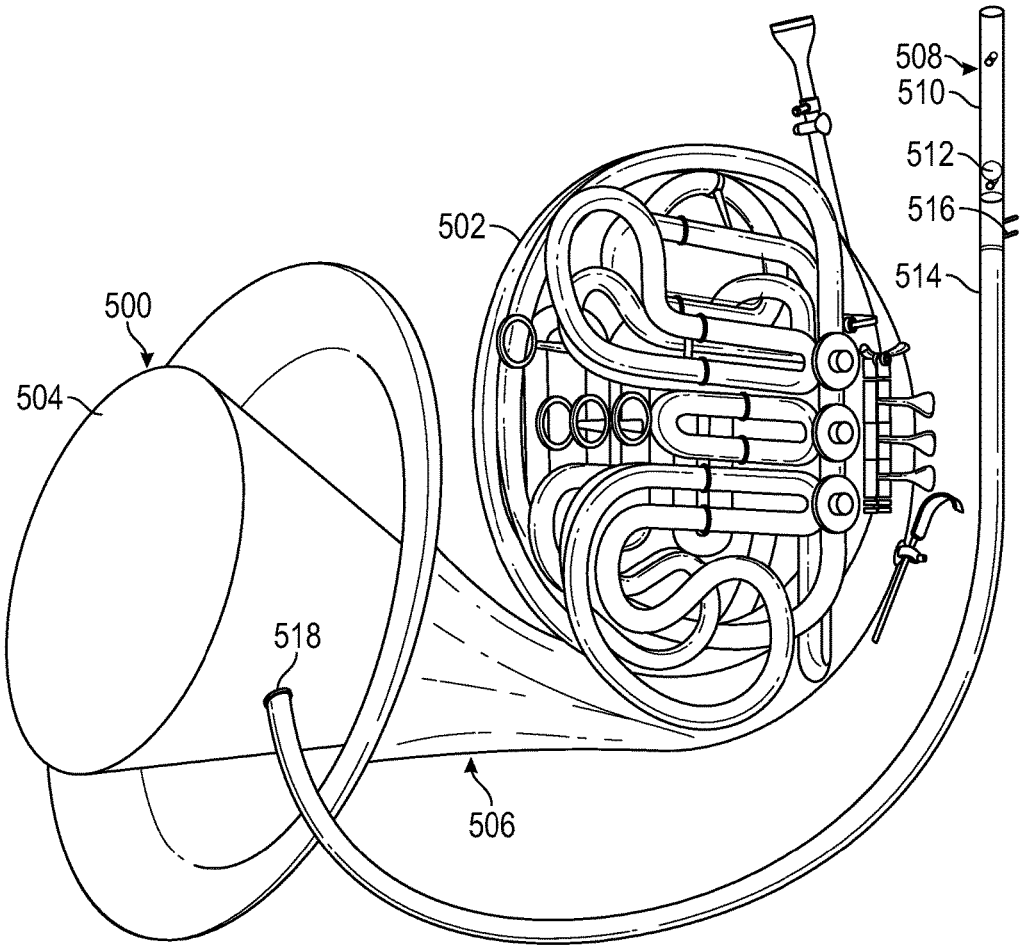
FIG. 5 depicts a french horn in combination with an alternative configuration for an airflow indicator.

Referring now to FIG. 5, depicted therein is a french horn 502 having an alternative embodiment of an airflow indicator 500 engaged with the instrument. The visible configuration of different wind instruments, particularly brass-wind instruments, dictates alternative structures for the airflow indicators for use with those instruments. Because the bell of the French horn extends to the back and side of the player, a visible indicator located at the bell of the instrument would be of little use to a player. Airflow indicator 500 again includes a mute-like body member 504 that engages the bell section, indicated generally at 506, of the instrument. The visual display assembly 508, here again including a display tube 510 and a retained ball 512, is coupled to a flexible conduit 514 which extends between the interior of body member 504 and provides fluid communication between the interior of body member 504 and tube 510. A clip 516 may be provided may be provided to facilitate coupling either flexible conduit 514 or display tube 510 to a nearby and convenient surface (for example the player's music stand) for the player's ability to see it. Flexible conduit 514 may be of virtually any reasonable length deemed suitable, as the length of the conduit is not a significant factor in functioning of the visual display assembly. To simplify movement of conduit 514 and placement of tube 510 in a desired location, in this example embodiment, conduit 514 is coupled to body member 504 through a rotatable coupling 518. A similarly configured airflow indicator, adapted primarily in dimension, might be used with a baritone or euphonium.

Figure 6:
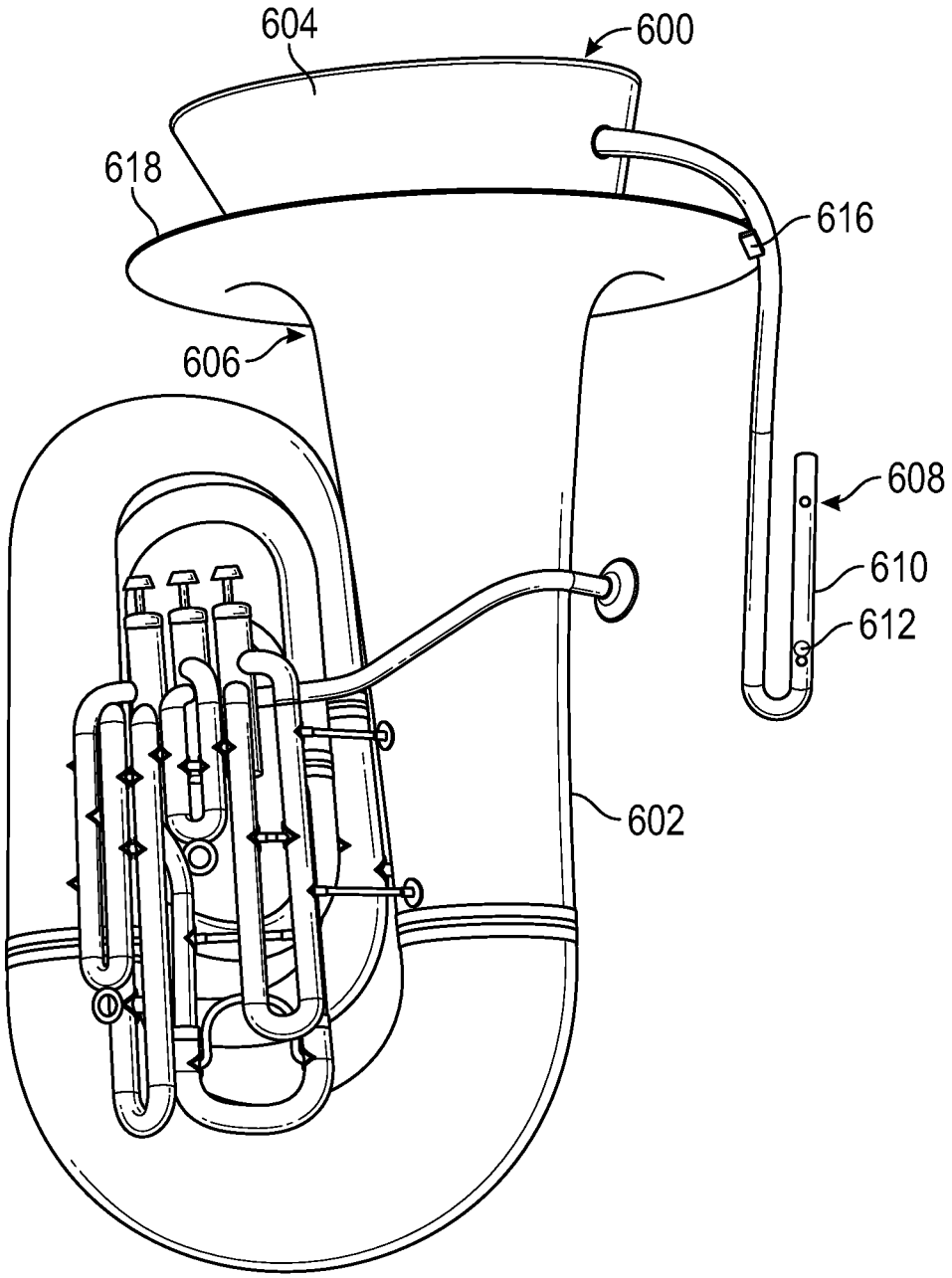
FIG. 6 depicts a larger brass-wind in the form of a tuba with another alternative configuration for an airflow indicator.

Referring now to FIG. 6, that figure depicts another alternative embodiment of an airflow indicator 600 in an operating engagement with a tuba. In this embodiment the bell of the instrument will be above the player's head, thereby necessitating another configuration. Again, airflow indicator 600 includes a mute like body member which engages the bell portion of the instrument, indicated generally at 606. Again, the display assembly is in the form of a transparent display tube 610 having a ball 612 retained therein. In this case however in order to maintain the vertical orientation of the tube, the tube is incorporated with other structures to form a generally rigid U-shaped assembly, indicated generally at 608, which is coupled by a flexible tube 614 to the interior of body member 604. Again, a clip 616 may be provided to engage a convenient surface. Due to the rim of the bell 618 of the instrument being above the players head, in the depicted example that surface is the bell rim 618 of the tuba 602. A similar configuration of airflow indicator, though of a smaller size, might be used with baritones and/or euphoniums.

Figure 7:
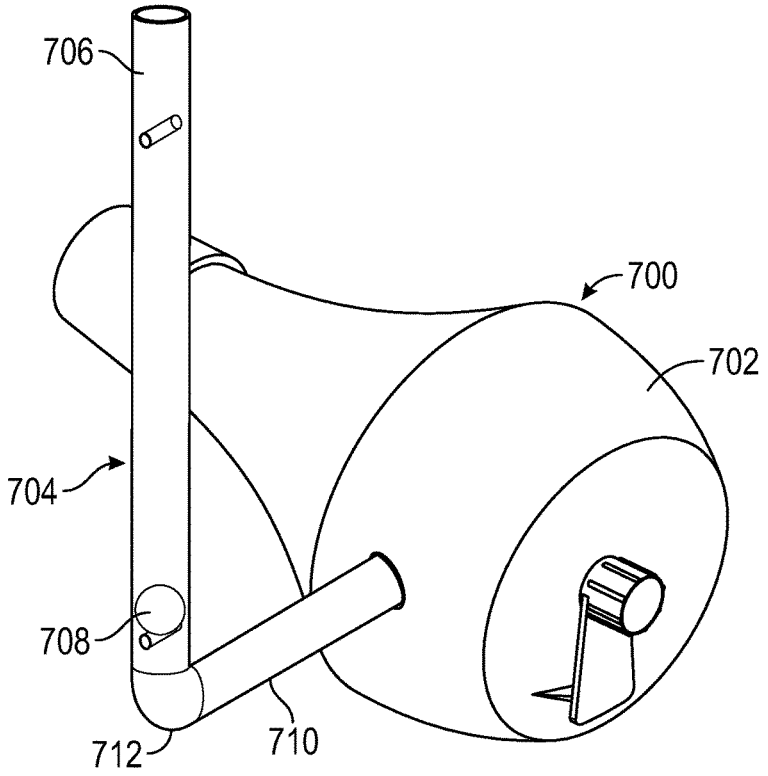
FIG. 7 depicts an alternative configuration for an airflow indicator having configuration useful for generally horizontally supported brass-winds, such as a trumpet or trombone.

Referring now to FIG. 7, therein is depicted yet another alternative embodiment of an airflow indicator 700 in accordance with the present description. Airflow indicator 700 is of a type intended for use with either trumpet or trombone, or similar generally horizontally held instruments (for example cornets, flugelhorns, etc.). Though, as will be readily apparent to persons skilled in the art the size of the body member 702 will vary between examples for different of such instruments. Airflow indicator 700 is adapted to move the display assembly 704, including tube 706 and ball 708 from extending directly from the top of body member 702 as occurred with airflow indicator 200 of FIGS. 2, 3A, and 4. Instead, the display assembly 608 is supported by a lateral tube extending from body member 702, and having an elbow 712 to support tube 706 and a generally vertical orientation. This offset of the display assembly can have different implications for different instruments. For example, for a trombone, where the bell of the instrument is offset to the left of the player's face, the offset can place the display tube directly in front of the player. However, for trumpet, the offset of the display tube may serve to allow the player to still view the tube with peripheral vision but also to read music unimpaired by the presence of the display tube directly in front of his or her eyes.

Figure 8:
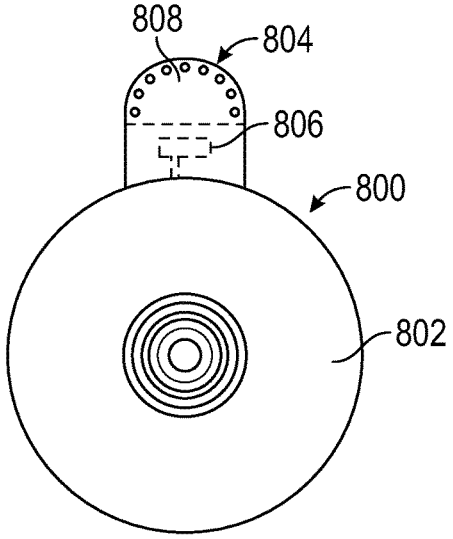
FIG. 8 depicts an alternative configuration for an airflow indicator having an alternative form of pressure sensor and or display.

Referring now to FIG. 8, therein is depicted an alternative embodiment of an airflow indicator 800, illustrated from an end view looking at the end that would be inserted into the bell of an instrument. Airflow indicator 800 includes a body member 802 coupled to an electronic display assembly 804.

The previously discussed examples have used what might be described as an analog measurement of the airflow wherein the position of the visual indicator is directly responsive to the applied air pressure. Another alternative, however, is to use a pressure sensor 806 either within or in fluid communication with body member 802 to monitor air pressure within the body member 802 and to generate a representative signal on a display 808. Barometric-type sensors are well known which are capable of making this form of measurement. In some cases, the display might be an analog display responsive to a varying signal from the pressure sensor 806. However it is currently anticipated that if a pressure sensor based measurement were to be made, it would be desirable to use a digital display for display 808. Use of a digital display would allow additional options as to display of information to a user. For example, an analog measurement is essentially always in real time. However, if a digital display were to be used, the display might show a current pressure as well as a maximum and a minimum pressure experienced during a certain period (for example as selected by inputs on the display).

As will be apparent to persons skilled in the art having the benefit of this description, the digital display could be of any desired form, which might be considered by analogy relative to various forms of display used for digital tuners for musicians and the like. Thus, the digital display might be an arcuate representation of sensed pressures analogous to an analog meter, or could be a linear representation of optical indicators analogous to the tube and ball of the preceding embodiments.

Many variations may be made in the structures and techniques described and illustrated herein without departing from the scope of the inventive subject matter. Accordingly, the scope of the inventive subject matter is to be determined by the scope of the following claims and all additional claims supported by the present disclosure, and all equivalents of such claims.

What is claimed is:

1. An airflow indicator for a wind musical instrument, comprising:

a body member defining a partially closed chamber, the body member configured to engage the wind musical instrument to place an entrance to the partially closed chamber proximate a bell of the instrument and to restrict airflow through the instrument when played, the body member having a tapered portion configured to engage a tapering portion of a wind musical instrument proximate the bell, and to allow an audible sound from the instrument when played, and wherein the body member further comprises a valve mechanism operable to control airflow through one or more openings in the body member to regulate airflow through the body member;

a display assembly operably coupled to the body member, the display assembly responsive to the restricted air flow and configured to provide an observable indicator of relative airflow through the musical instrument from a player in addition to the audible sound from the instrument.

2. The airflow indicator of claim 1, wherein the tapered portion of the body member includes an externally facing sealing portion which engages the inner bore of the wind musical instrument to at least partially restrict the flow of air past the partially closed chamber.

3. The airflow indicator of claim 2, when the externally facing sealing portion of the partially closed chamber comprises one or more pieces of a sealing material arranged to extend around at least a portion of the outer circumference of a portion of the partially closed chamber.

4. The airflow indicator of claim 1, wherein the display assembly comprises:

a display tube in fluid communication with the interior of the partially closed chamber; and movable indicator retained within the tube, the indicator movable in response to changes in air pressure within the body member.

5. The airflow indicator of claim 4, wherein the tube is at least partially transparent.

6. The airflow indicator of claim 4, wherein the display assembly is physically supported by the body member, and wherein the body member is configured to engage the musical instrument such that the airflow indicator is entirely supported by the instrument, and therefore movable with the instrument.

7. The airflow indicator of claim 1, wherein the body member has a generally mute-like configuration.

8. The airflow indicator of claim 1, wherein the display assembly comprises:

an air pressure sensor in communication with the body member, and an optically viewable meter coupled to the air pressure sensor and adapted to convey an indicator of changes in air pressure proximate the body member.

9. The airflow indicator of claim 8, wherein the air pressure sensor is an electronic sensor, and wherein the optically viewable meter comprises a digital display.

10. An airflow indicator for a wind musical instrument, comprising:

a body member defining a partially closed chamber, the body member configured to engage the wind musical instrument proximate a bell of the instrument and to restrict airflow through the instrument, the body member having a tapered portion configured to engage a tapering portion of a wind musical instrument proximate the bell;

a display assembly operably coupled to the body member, the display assembly responsive to the restricted air flow and configured to provide an observable indicator of relative airflow through the musical instrument, wherein the body member further comprises a valve mechanism operable to control airflow through one or more openings in the body member to regulate airflow through the body member; and wherein the body member is further configured to provide no more than a minimal effect on the pitch of a note played on the instrument when the body member engages the instrument, relative to that pitch played on the instrument without the body member engaged.

11. The airflow indicator of claim 10, wherein the display tube is in communication with the interior of the body member through a flexible conduit.

12. An airflow indicator for a wind musical instrument having valves and a bell, comprising:

a body member defining an internal chamber, the body member having a generally tapering instrument engaging portion configured to be insertable into the bell end of the musical instrument and to be retained in position by engagement within the bell portion of the instrument to place an opening to the internal chamber proximate the bell portion of the instrument, wherein engagement of the body member within the bell portion of the instrument restricts airflow through the musical instrument when the instrument is played and as the sound of the instrument is audible, and wherein the body member further comprises a valve mechanism operable to control airflow through one or more openings in the body member to regulate airflow through the body member;

an airflow display coupled in fluid communication with the body member and responsive to airflow within the instrument proximate the body member, the airflow display including, a generally linear tube, at least a portion of which is transparent; and a movable element within the tube.

13. The airflow indicator of claim 12, which is configured to engage at least one of any member of the brass instrument family of instruments.

14. The airflow indicator of claim 13, which is configured to engage at least one of: a trumpet, a trombone, a french horn, and a tuba.

15. The airflow indicator of claim 12, wherein the generally linear tube is in communication with the body member through a flexible conduit.

16. An airflow indicator for a wind musical instrument having valves and a bell, comprising:

a body member defining an internal chamber, the body member having a generally tapering instrument engaging portion configured to be insertable into the bell end of the musical instrument and to be retained in position by engagement within the bell portion of the instrument, wherein engagement of the body member within the bell portion of the instrument restricts airflow through the musical instrument wherein the body member further comprises a valve structure operable to vary the amount of restriction of airflow through the body member;

an airflow indicator coupled in fluid communication with the body member and responsive to airflow within the instrument proximate the body member, the airflow indicator including, a generally linear tube, at least a portion of which is transparent; and a movable element within the tube.

17. The airflow indicator of claim 16, wherein the generally linear tube has a first end that extends into the internal chamber of the body member.

18. The airflow indicator of claim 17, wherein the generally linear tube is removably coupled to the body member.

19. The airflow indicator of claim 18, wherein the generally linear tube is removably coupled to the body member by engagement with an elastomeric grommet which engages an aperture in a surface surrounding the internal chamber.

20. The airflow indicator of claim 16, wherein the body member is configured to have an insubstantial effect on the pitch of a note played on the instrument when the body member engages the instrument, relative to that pitch played on the instrument without the body member engaged.

21. A method of manufacturing an airflow indicator for a brass-wind musical instrument, comprising:

on a mute sized and configured to engage the bell region of a brass-wind musical instrument, the mute defining an interior cavity having an opening proximate the bell region, forming an aperture in the mute to provide communication with the interior cavity of the mute;

forming a moveable valve mechanism operable to control airflow through one or more openings in the body member to regulate airflow through the body member; and coupling a pressure-responsive assembly in fluid communication with the interior cavity through the aperture, the pressure responsive assembly providing a visual indicator of the volume of airflow into the interior cavity of the mute.

22. An airflow indicator for a wind musical instrument, comprising:

a body member defining a partially closed chamber, the body member configured to engage the wind musical instrument to place an entrance to the partially closed chamber proximate a bell of the instrument and to restrict airflow through the instrument when played, the body member having a tapered portion configured to engage a tapering portion of a wind musical instrument proximate the bell, and to allow an audible sound from the instrument when played;

a display assembly operably coupled to the body member, the display assembly responsive to the restricted air flow and configured to provide an observable indicator of relative airflow through the musical instrument from a player in addition to the audible sound from the instrument; and wherein the body member is further configured to provide no more than a minimal effect on the pitch of a note played on the instrument when the body member engages the instrument, relative to that pitch played on the instrument without the body member engaged.

* * * * *